US005192157A

United States Patent [19]

Laturner

[11] Patent Number: 5,192,157

[45] Date of Patent: Mar. 9, 1993

[54] VEHICLE CRASH BARRIER

[75] Inventor: John F. Laturner, Carmichael, Calif.

[73] Assignee: Energy Absorption Systems, Inc., Chicago, Ill.

[21] Appl. No.: 710,830

[22] Filed: Jun. 5, 1991

[51] Int. Cl.[5] ..... E01F 15/00

[52] U.S. Cl. ..... 404/6; 256/13.1

[58] Field of Search ..... 404/6, 9; 256/1, 13.1; 188/1 C

[56] References Cited

U.S. PATENT DOCUMENTS

| | | | |
|---|---|---|---|
| 3,503,600 | 3/1970 | Rich . | |
| 3,606,258 | 9/1971 | Fitch | 404/6 |
| 3,666,055 | 5/1972 | Walker | 256/13.1 |
| 3,674,115 | 7/1972 | Young et al. | 404/6 X |
| 3,856,268 | 12/1974 | Fitch | 256/13.1 |
| 3,880,404 | 4/1975 | Fitch . | |
| 3,982,734 | 9/1976 | Walker | 256/13.1 |
| 4,101,115 | 7/1978 | Meinzner | 256/13.1 X |
| 4,290,585 | 9/1981 | Glaesener | 256/13.1 |
| 4,321,989 | 3/1982 | Meinzer . | |
| 4,352,484 | 10/1982 | Gertz et al. . | |
| 4,399,980 | 8/1983 | van Schie . | |
| 4,452,431 | 6/1984 | Stephens et al. . | |
| 4,635,981 | 1/1987 | Friton . | |
| 4,645,375 | 2/1987 | Carney | 404/9 X |
| 4,674,911 | 6/1987 | Gertz | 404/6 |
| 4,688,766 | 8/1987 | Zucker | 256/13.1 |
| 4,711,481 | 12/1987 | Krage et al. . | |
| 4,822,208 | 4/1989 | Ivey . | |
| 4,844,213 | 7/1989 | Travis . | |
| 4,909,661 | 3/1990 | Ivey . | |
| 5,011,326 | 4/1991 | Carney | 188/371 |
| 5,106,554 | 4/1992 | Drews | 404/6 X |

OTHER PUBLICATIONS

Drawing No. 35-09-51-E "Hex-Foam II Cartridge Exploded View" dated Jul. 1987.

Drawing No. 21-00-07 "(HexFoam II Cartridges) Core Assy", Honeycomb Steel (Type 51) dated Nov. 11, 1986.

*Primary Examiner*—Thuy M. Bui

*Assistant Examiner*—Nancy Connolly

*Attorney, Agent, or Firm*—Willian Brinks Olds Hofer Gilson & Lione

[57] ABSTRACT

An energy-absorbing crash barrier is provided with multiple energy-absorbing elements. Each element includes an expanded metal sheet formed as a tubular column which is internally braced with foam. In some of the sections multiple metal columns are provided, one eccentrically positioned within the other. The expanded metal columns provide the major energy-absorbing elements of the barrier, and the eccentrically positioned columns define a preferred bending direction which tends to redirect an axially impacting vehicle away from a hardpoint. The columns in the individual elements are graduated in axial stiffness such that a forward section tends to collapse before the rearward sections, thereby providing staged collapse.

47 Claims, 7 Drawing Sheets

FIG.6
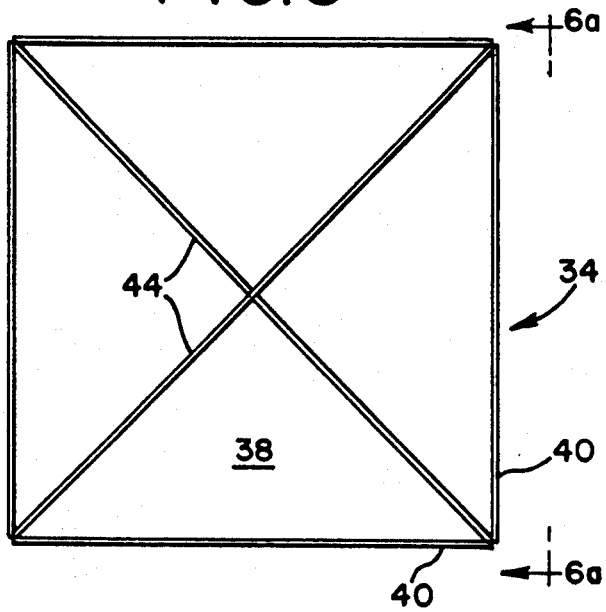
FIG.6a
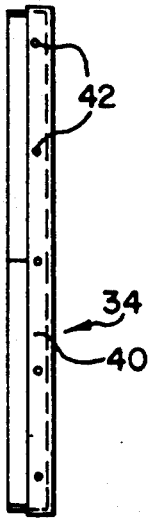
FIG. 6b
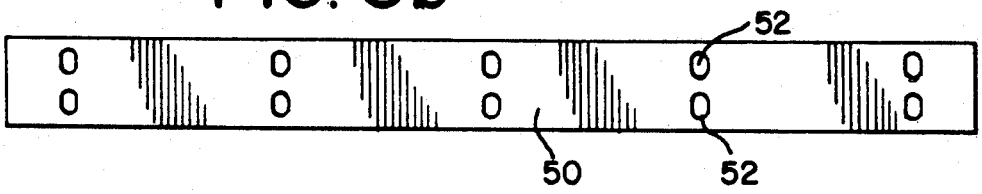
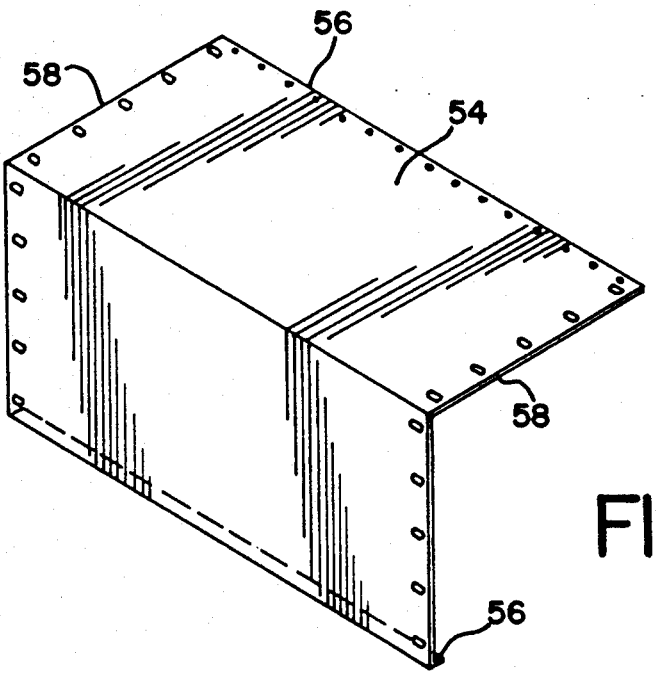
FIG. 7

VEHICLE CRASH BARRIER

BACKGROUND OF THE INVENTION

This invention relates to a crash barrier of the type designed to be positioned alongside a roadway to decelerate an impacting vehicle in a controlled manner.

Crash barriers of the general type described above have been designed utilizing a wide variety of energy-absorbing materials. For example, U.S. Pat. Nos. 4,452,431 and 3,503,600 disclose energy-absorbing devices using water-filled containers. The devices disclosed in U.S. Pat. No. 4,352,484 use honeycomb material which is filled with foam and which operates by compressing the foam and causing adjacent layers of honeycomb material to cut into one another. U.S. Pat. No. 4,399,980 discloses another system using bendable tubes positioned between diaphragms, and U.S. Pat. No. 4,635,981 discloses metal columns reinforced with foam. U.S. Pat. No. 4,711,481 discloses metal column cross braced with plates or straps to reduce buckling.

Meinzer, U.S. Pat. No. 4,321,989, discloses a crash barrier having an array of bays, each containing an element that is filled with an energy-absorbing foam (FIGS. 4 and 5). A wire mesh basket is positioned inside the foam element to contain the foam within the basket to prevent portions of the foam from escaping as the element is crushed. Somewhat similarly, Ivy, U.S. Pat. No. 4,909,661, discloses a crash barrier having an upper portion formed of a collapsible material in which is embedded a wire mesh reinforcement of the type shown in FIGS. 18 and 19.

The approaches described in the above-identified patents are characterized by a number of disadvantages. In many cases, the column stability of the energy-absorbing element is low. Often expensive and sometimes bulky frameworks are required to prevent the crash barrier (which has a substantial length) from buckling in an undesirable manner during an impact. Some of the devices described above appear to rely primarily on the compressible foam for energy-absorption. Note in particular that the reinforcing baskets shown in the Meinzer and Ivy patents appear to be of light gauge material which is not sufficiently rigid to cause deformation of the material to contribute any substantial fraction of the energy-absorbing capacity of the element. This is not surprising in view of the apparent use of the basket to retain the foam during an impact, and not to act as a principal energy-absorbing element. Another common disadvantage is that metal columns such as those disclosed in U.S. Pat. No. 4,635,981 will often tend to fail in a buckling mode, in which a relatively small fraction of the metal is strained, often to a relatively small degree. This represents an inefficient use of the metal in the energy absorbing elements, and such inefficiency results in a lower energy absorption capacity than would be possible if a greater proportion of the metal were strained to a greater degree.

It is accordingly an object of this invention to provide a crash barrier that provides improved column stability such that the need for bracing frameworks is reduced or eliminated, that provides improved efficiency by straining a large volume of rigid components to a large extent, that is readily adapted to advanced designs which are intended both to redirect an axially impacting vehicle as well as to slow it, and that can be implemented in a lightweight, low-cost form that is relatively compact and well-suited for use in situations where limited space is available for a crash barrier.

SUMMARY OF THE INVENTION

According to a first aspect of this invention, a vehicle crash barrier adapted to decelerate an impacting vehicle is provided, comprising at least one energy-absorbing element comprising a column and a foam disposed within the column. The column comprises a sheet of material which defines an array of perforations extending along and around the column. The column defines a longitudinal axis and has a sufficient rigidity such that, when an impacting vehicle having an initial kinetic energy impacts the energy-absorbing element and collapses the column along the longitudinal axis, the foam braces the column against buckling, and deformation of the column absorbs a greater fraction of the initial kinetic energy than does deformation of the foam.

By using a perforated sheet in the column, it has been found that a relatively large volume of the sheet can be strained to a relatively large degree during axial collapse, thereby enhancing energy-absorbing capacity per unit weight of the sheet. The foam braces the column and improves the stability of the column with respect to a long column or Euler buckling, thereby reducing the need for external frameworks.

According to a second aspect of this invention, a vehicle crash barrier is provided having at least one energy-absorbing element comprising a column and a foam disposed within the column. As above, the column comprises a sheet of material which defines an array of perforations extending along and around the column. The energy-absorbing element and the column each define a respective central longitudinal axis, and these axes are offset with respect to one another such that the column is eccentric toward a first side of the energy-absorbing element along a transverse axis. The column has a sufficient rigidity to define a preferred bending direction for the energy-absorbing element, and this preferred bending direction is generally aligned with the transverse axis such that a redirecting force aligned with the transverse axis is applied to an axially impacting vehicle during axial collapse of the energy-absorbing element.

By eccentrically positioning the column within the energy-absorbing element, the energy-absorbing element is provided with the capability of redirecting an impacting vehicle during an axial impact, thereby protecting the occupants of the vehicle in the event the vehicle is not stopped prior to complete collapse of the energy-absorbing element.

According to a third aspect of this invention, a vehicle crash barrier is provided comprising a plurality of energy-absorbing elements arranged along a longitudinal axis from a forward end to a rearward end. At least first and second ones of the energy-absorbing elements each comprise at least one column substantially aligned with the longitudinal axis and a foam disposed within the column. Each of the columns comprises a respective sheet of material which defines an array of perforations extending along and around the column. The first energy-absorbing element is positioned closer to the forward end than is the second energy-absorbing element, and the columns are configured to provide increased axial stiffness to the second than to the first energy-absorbing element, such that the first energy-absorbing element is predisposed to begin to collapse axially before the second energy-absorbing element when the crash barrier is struck at the forward end by an impacting vehicle.

By selecting the stiffness of the energy-absorbing columns appropriately along the length of the crash barrier, a staged collapse may be achieved, in which the forward energy-absorbing columns begin to collapse prior to the rearward columns. In this way, the column stability of the crash barrier can be increased, and an increasing decelerating force may be applied to the impacting vehicle during collapse of the barrier.

BRIEF DESCRIPTION OF THE DRAWINGS

FIG. 6 is a rear view of one of the caps of the element of FIG. 3.

FIG. 6*a* is a side view taken along line 6*a*—6*a* of FIG. 6.

FIG. 6*b* is a plan view of a coupling strap used to couple adjacent energy-absorbing elements of FIG. 2 together.

FIG. 7 is a perspective view of a portion of a skin panel included in the embodiment of FIG. 2.

DETAILED DESCRIPTION OF THE PRESENTLY PREFERRED EMBODIMENTS

Figure 1:
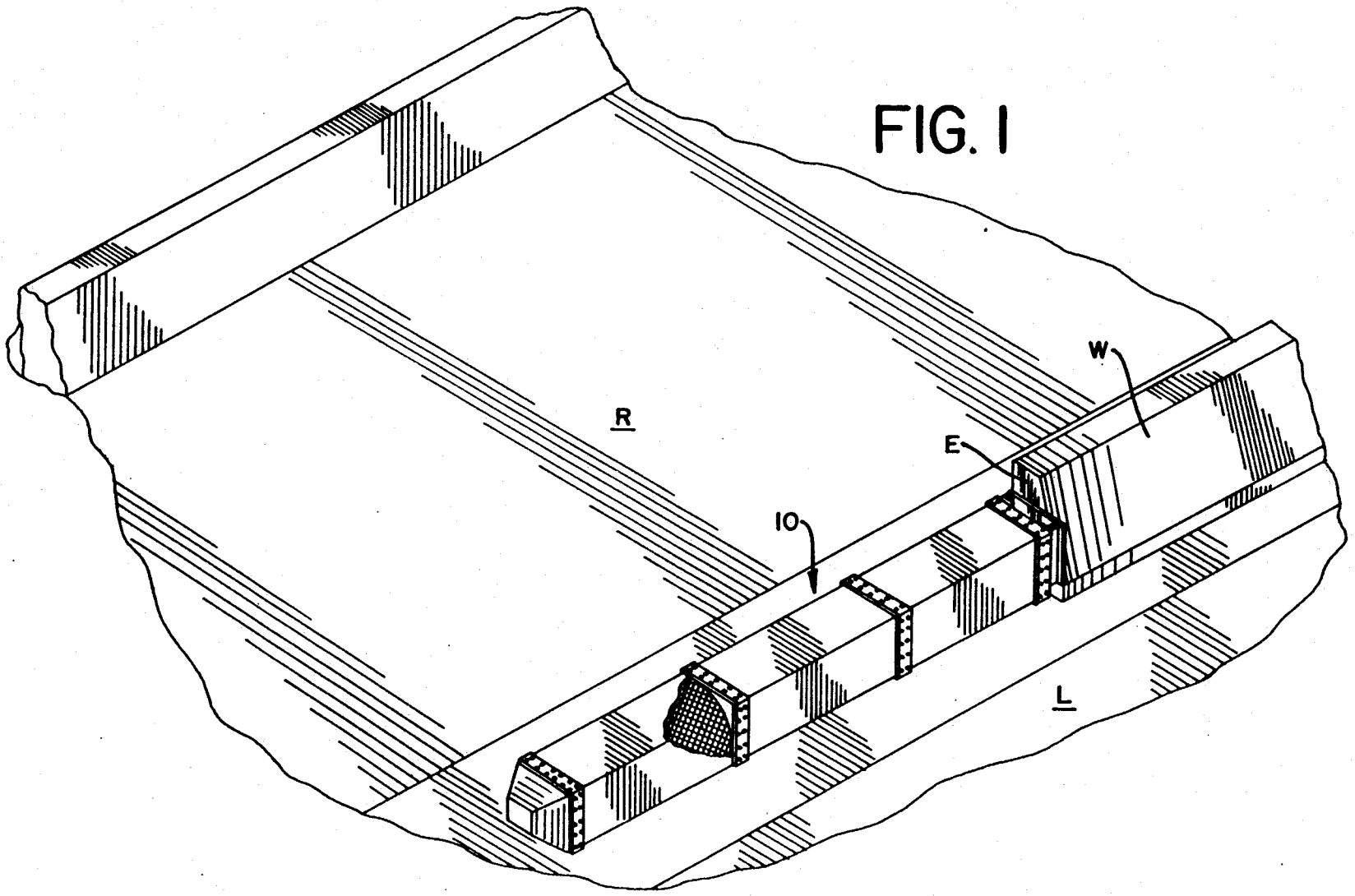
FIG. 1 is a perspective view showing a preferred embodiment of the crash barrier of this invention installed in place on a racetrack.

Turning now to the drawings, FIG. 1 shows a perspective view of a crash barrier 10 that incorporates a presently preferred embodiment of this invention. In FIG. 1 the crash barrier 10 is mounted to one end E of a wall W that separates a racetrack R from a lane L proceeding to a pit area (not shown). The end E represents a hard point and a significant danger to drivers on the racetrack R. The wall W is typically only 18 to 24 inches wide and no more than about 3 feet high. Furthermore, race cars may have an unusually low center of gravity, as low as about 13 inches or less. These dimensions represent severe constraints, and the crash barrier 10 has been designed not to extend beyond the cross-sectional dimensions of the wall W, and to operate with limited length and a complete absence of external bracing.

Figure 2:
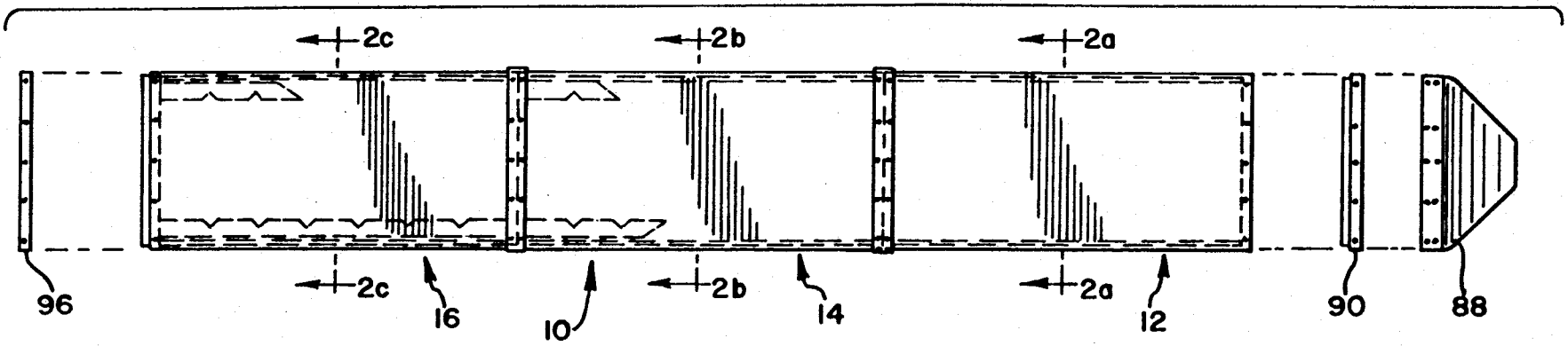
FIG. 2 is a partially exploded top view of the crash barrier of FIG. 1.

As shown in FIG. 2, the crash barrier 10 of this example is made up of three separate energy-absorbing elements: a forward section 12, a middle section 14, and a rear section 16. The construction of the sections 12, 14, 16 will be described in detail below. However, by way of introduction it can be said that each of the sections 12, 14, 16 includes at least one cylindrical column made of a perforated metal sheet such as expanded metal which is filled with a low density foam such as a polyurethane foam. The foam braces the expanded metal columns against undesired long column buckling, and promotes a controlled axial collapse that places a large percentage of the metal of the expanded metal columns in strain to relatively high degree.

Figure 2A:
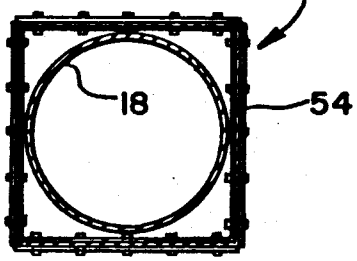
FIGS. 2*a*, 2*b* and 2*c* are cross-sectional views taken along lines 2*a*—2*a*, 2*b*—2*b*, and 2*c*—2*c* of FIG. 2, respectively.
Figure 2B:
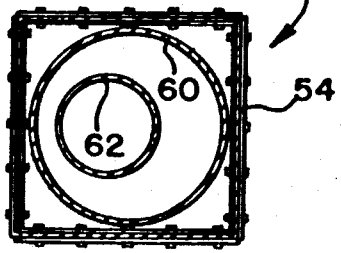
Figure 2C:
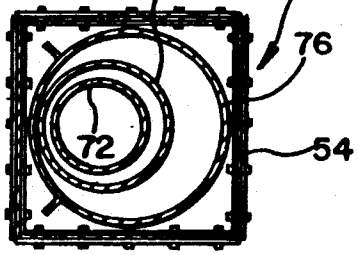

FIGS. 2*a*, 2*b* and 2*c* are cross-sectional views of sections 12, 14, 16, respectively. FIGS. 2*a*, 2*b* and 2*c* show the respective expanded metal columns in dotted lines, and indicate that the sections 12, 14 and 16 have differing numbers of nested columns. This feature promotes sequential staged collapse of the barrier 10 from front to back. Additionally, some of the columns are offset with respect to the centerline of the barrier 10, an arrangement which enhances the ability of the crash barrier to re-direct an axially impacting vehicle away from the end E of the wall W.

Each of the sections 12, 14, 16 is itself sufficiently rigid to be free-standing, and adjacent sections 12, 14, 16 are rigidly secured together such that when the rearward portion of the rear section 16 is secured in place to the wall W, the entire crash barrier 10 acts as a cantilevered beam to hold the sections 12, 14, 16 in position parallel to and above a roadway without auxiliary bracing or frameworks. The following discussion will take up the construction of each of the sections 12, 14, 16 in detail.

Figure 5B:
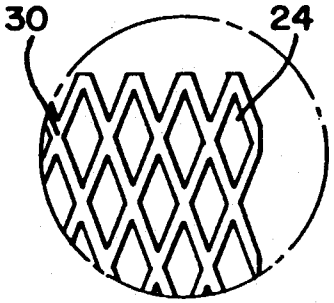
FIGS. 5*a* and 5*b* are enlarged views of the encircled regions 5*a*, 5*b* of FIG. 5, respectively.
Figure 3:
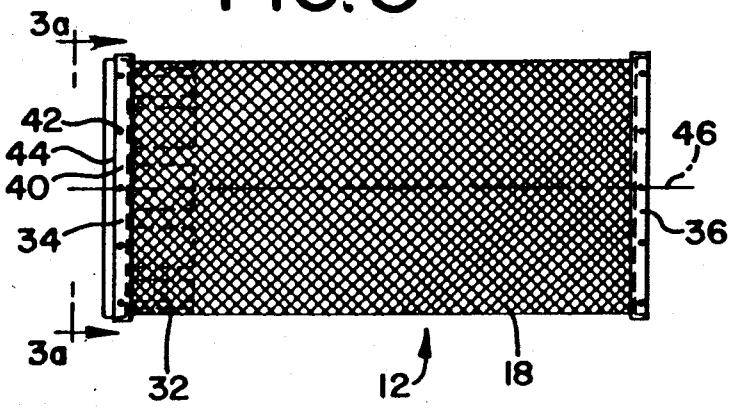
FIG. 3 is a side view of the front energy-absorbing element of FIG. 2.
Figure 5:
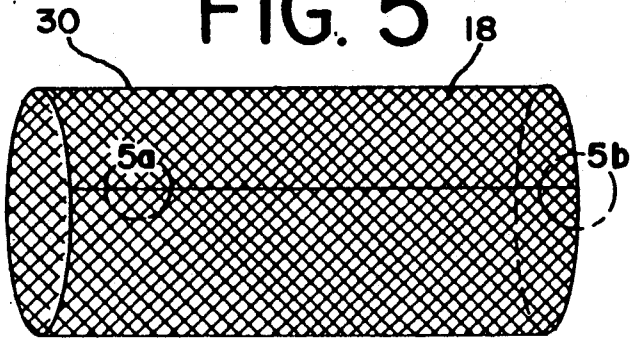
FIG. 5 is a perspective view of an expanded metal column included in the element of FIG. 3.
Figure 5A:
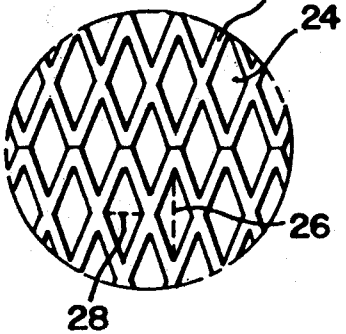

FIG. 3 shows a side view of the forward section 12, with the external skin removed. The forward section 12 includes a column 18 and end caps 34, 36. As shown in greater detail in FIG. 5, the column 18 is formed of a sheet 30 of expanded metal in this embodiment. The expanded metal defines an array of perforations 24, each of which in this embodiment is diamond shaped and defines a major axis 26 and a minor axis 28. Preferably, the expanded metal sheet 30 is cut as shown in FIGS. 5*a* and 5*b* along the center of the nodes, and the adjacent edges of the expanded metal sheet 30 are welded together as shown in FIG. 5*a* at each point of contact to form a tubular cylinder.

Figure 4:
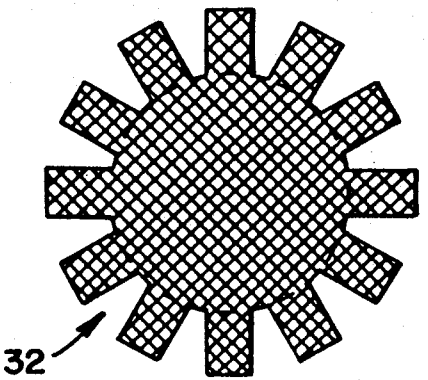
FIG. 4 is a plan view of a retainer included in the element of FIG. 3 prior to folding.

Once the column 18 is formed, a retainer 32 is placed Within the column 18. The retainer 32 has an initial shape as shown in FIG. 4, and a folded configuration as shown in FIG. 3. The ends of the column 18 are then secured to the end caps 34, 36, as for example by welding. As shown in FIGS. 6 and 6*a*, the end cap 34 is formed of a metal sheet 38 with folded flanges 40 on all four sides. Each of the flanges 40 defines mounting holes 42, and the end cap 34 is braced with diagonal braces 44, which are preferably welded in place to stiffen and strengthen the end cap 34. The end cap 36 is identical to the end cap 34, but the braces 44 have been eliminated. Preferably, the ends of the column 18 are welded to the end caps 34, 36 at each point of contact, and the retainer 32 is secured to the column, as for example with twisted wires or welds.

Figure 3A:
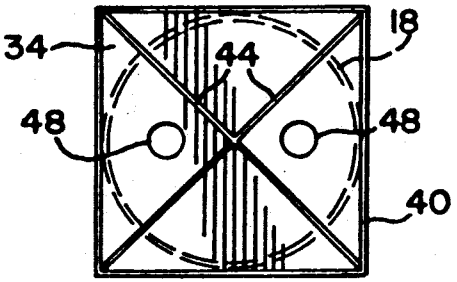
FIG. 3*a* is a rear view taken along line 3*a*—3*a* of FIG. 3.

As shown in FIGS. 3 and 3*a*, the forward section 12 defines a longitudinal axis 46 which is coincident with the central longitudinal axis of the column 18. Openings 48 are provided in the end cap 34 to facilitate introduction of a foaming material into the interior of the column 18 as described below.

FIG. 6*b* is a plan view of a coupling strap 50 used to secure adjacent sections 12, 14, 16 together. The coupling strap 50 includes paired openings 52 sized to receive fasteners that secure the adjacent sections 12, 14, 16 together.

FIG. 7 shows a perspective view of a skin panel that is secured between the end caps 34, 36 to improve the appearance of the finished crash barrier 10. Each of the sections 12, 14, 16 includes two of the skin panels 54, which are secured to each other along axially-extending edges 56 and to the end caps 34, 36 at the ends 58.

Figure 8A:
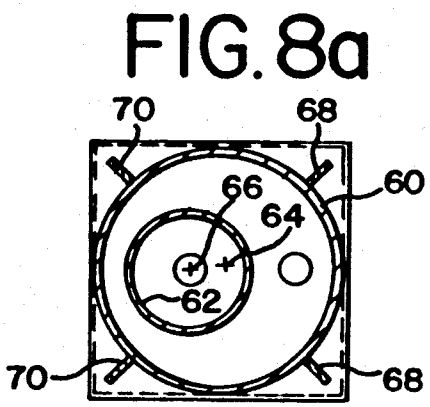
FIGS. 8*a* and 8*b* are cross-sectional and rear-elevational views taken along lines 8*a*—8*a* and 8*b*—8*b* of FIG. 8, respectively.
Figure 8:
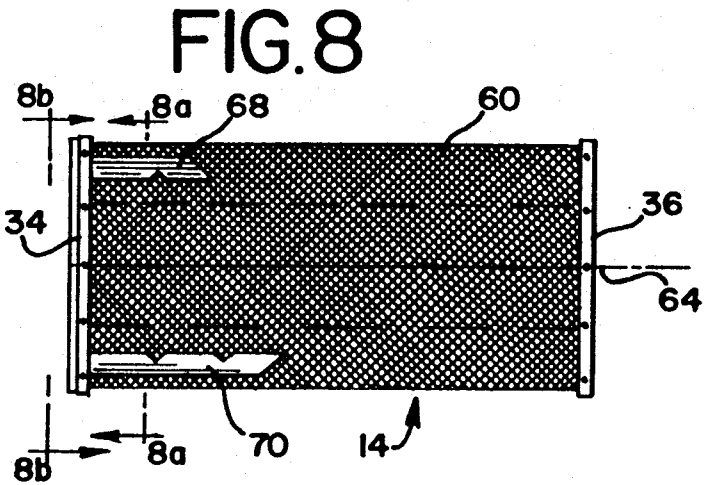
FIG. 8 is a top view of the central energy-absorbing element of FIG. 2.
Figure 8B:
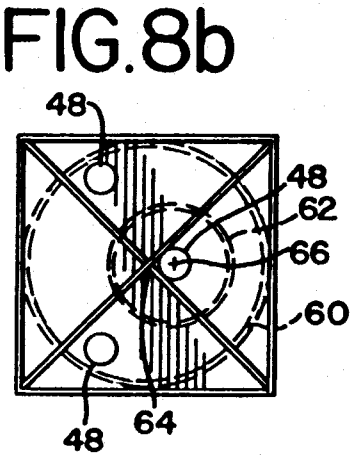

FIG. 8 shows a top view of the middle section 14. The middle section 14 is in many ways similar to the forward section 12 described above, and the same reference numerals will be used for corresponding parts.

Figure 9A:
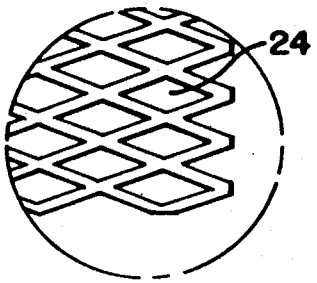
FIGS. 9*a* and 9*b* are enlarged views of the encircled regions 9*a*, 9*b* of FIG. 9, respectively.
Figure 9:
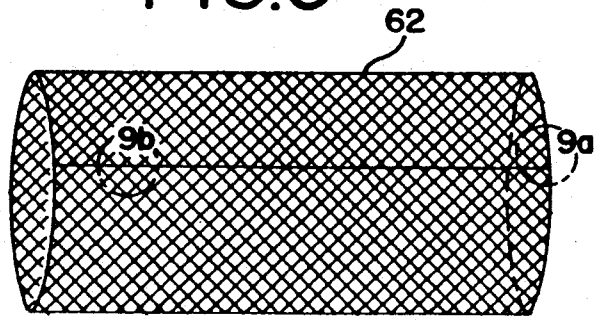
FIG. 9 is a perspective view of an expanded metal column included in the central energy-absorbing element of FIG. 8.
Figure 9B:
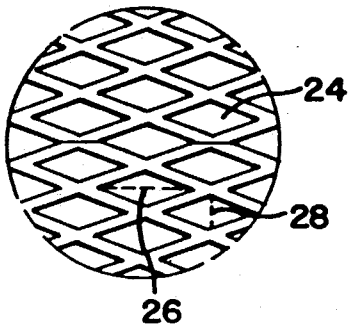

In contrast to the forward section 12, the middle section 14 includes two perforated metal columns 60, 62. The column 60 is formed as shown in FIGS. 9, 9*a* and 9*b*, and the column 62 is formed as shown in FIGS. 5, 5*a* and 5*b*. As before, the longitudinal seam is formed by cutting a sheet of expanded metal along the center of the nodes and then welding each of the adjacent contacting points together. Note that in contrast to the column 18, the major axis 26 of each of the perforations 24 of the column 60 is oriented axially, and the minor axis 28 of each of the perforations 24 is oriented circumferentially. As explained below, the orientation of the perforations 24 has been found to have an important effect on the manner in which the individual sections 12, 14, 16 collapse when impacted by a vehicle.

During assembly, the inner column 62 is secured between the end caps 34, 36 as described above. The outer column 60 is then positioned around the inner column 62 and welded into the cylindrical shape shown in FIG. 5. Then the ends of the outer column 60 are welded to the end caps 34, 36. As shown in FIG. 8, the outer column 60 defines a longitudinal axis 64 which is coincident with the longitudinal axis of the middle section 14. The inner column 62 defines a longitudinal axis 66 which is parallel but laterally offset from the longitudinal axis 64 such that the inner column 62 is eccentrically positioned with respect to the outer column 60. As explained below, this provides a preferred bending direction to the crash barrier 10.

Additionally, stiffeners 68, 70 are secured to the outer column 60, as for example by welding to the outer column and to the end cap 34. Note that the stiffeners 68 are shorter than the stiffeners 70, and the shorter stiffeners 68 are positioned opposite the inner column 62 as shown in FIG. 8*a*. The stiffeners 68, 70 are designed to strengthen the outer column 60 against bending and separation from the adjacent cap 34, and because of their asymmetrical positioning the stiffeners 68, 70 reinforce the preferred bending direction described below. The end cap 34 defines three openings 48 for the introduction of a foaming material as described below.

Figure 10A:
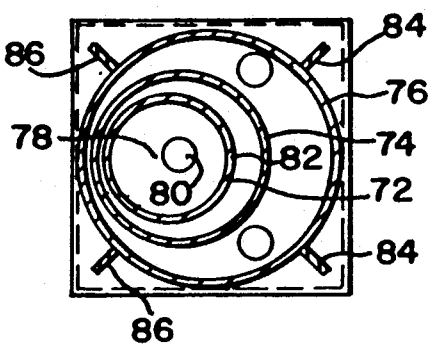
FIGS. 10*a* and 10*b* are cross-sectional and end views taken along lines 10*a*—10*a* and 10*b*—10*b* of FIG. 10, respectively.
Figure 10:
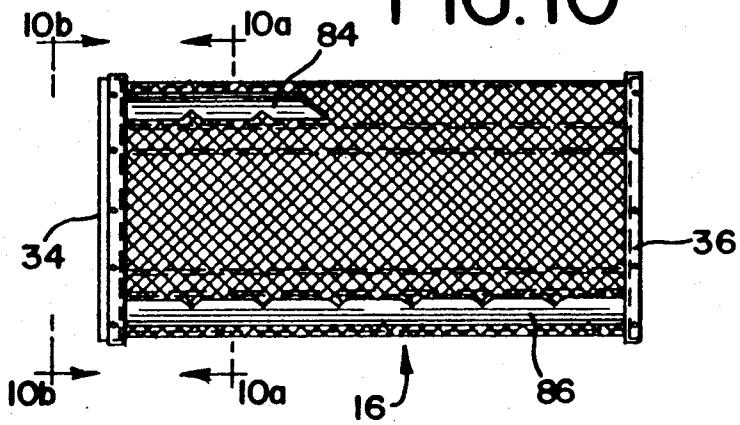
FIG. 10 is a top view of the rear energy-absorbing element of FIG. 2.
Figure 10B:
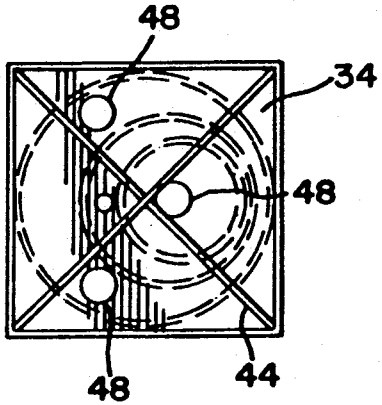

FIGS. 10, 10*a* and 10*b* provide more detailed drawings of the rear section 16 which includes three perforated metal columns 72, 74, 76. The column 76 is formed as shown in FIGS. 9, 9*a* and 9*b* with the major axis 26 of each of the perforations 24 oriented axially. The columns 72, 74 are formed as shown in FIGS. 5, 5*a* and 5*b*. The columns 72, 74, 76 define longitudinal axes 78, 80, 82, respectively, and as shown in FIG. 10*a* each of the axes 78, 80, 82 is laterally offset with respect to the others. Note that the inner and intermediate columns 72, 74 are offset to the same side of the crash barrier as is the inner column 62, so that both the middle and rear sections 14, 16 provide the same preferred bending direction. The rear section 16 includes stiffeners 84, 86. As before, the shorter stiffeners 84 are positioned opposite the inner column 72 such that the asymmetry of the stiffeners 84, 86 reinforces the tendency of the rear section 16 to bend in a selected direction (to the right as shown in FIG. 10*a*). The stiffeners 84, 86 are longer than the stiffeners 68, 70 to increase the bending stiffness of the rear section 16 as compared to the middle section 14.

Once the metallic portions of the sections 12, 14, 16 have been fabricated as described above, each of the sections 12, 14, 16 is then positioned with the openings 48 upwardly. Then the lower portion of the outer columns 18, 60, 76 are covered with a suitable tape and the surfaces of the outer columns 18, 60, 76 are wrapped with a suitable plastic film held in place with a fiber reinforced tape. Then a suitable foaming material is poured into the openings 48 to fill the entire region within the outermost column with a low density foam.

Once the foam has expanded and hardened, the skin panels 54 can be installed and then the sections 12, 14, 16 can be assembled together. This is done by aligning and compressing adjacent sections 12, 14, 16 together such that the diagonal braces 44 of the end caps 34 fit within the adjacent end caps 36. Once two adjacent sections 12, 14, 16 have been axially compressed together, fasteners are used in conjunction with the coupling straps 50 to secure the sections 12, 14, 16 together. Preferably, suitable keys (not shown) are provided in the cap 34 to ensure that the sections 14, 16 are assembled in the proper orientation. If desired, a suitable nose 88 made of a folded sheet of elastomer or metal may be secured to the forward end of the forward section 12 by means of a front cap 90 substantially identical to the caps 34. During assembly, the sections 12, 14, 16 should be oriented properly (as shown in FIG. 2) with the longer stiffeners 70, 86 positioned on the same side of the crash barrier 10 (which is the side toward which the eccentrically mounted columns 62, 72, 74 are offset).

The crash barrier 10 can be mounted to the end E of the wall W by a mounting fixture 92. The mounting fixture 92 includes a pair of spaced, parallel mounting brackets 94 fixed to the end E of the wall W. A backup cap 96 is bolted to the mounting brackets 94, and the end cap 34 of the rear section 16 can be secured to the backup cap 96 by coupling straps 50 of the type described above.

Figure 11B:
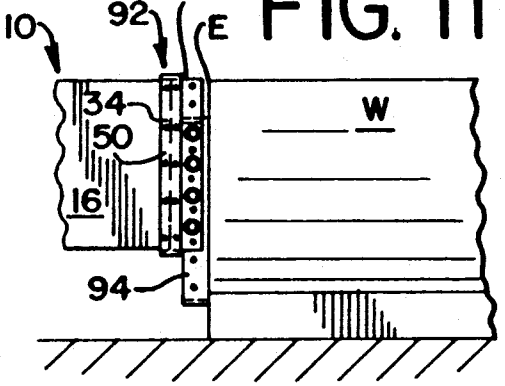
FIGS. 11*a* and 11*b* are side-elevational views showing the mounting of the crash barrier of FIG. 2 in first and second alternative positions.
Figure 11A:
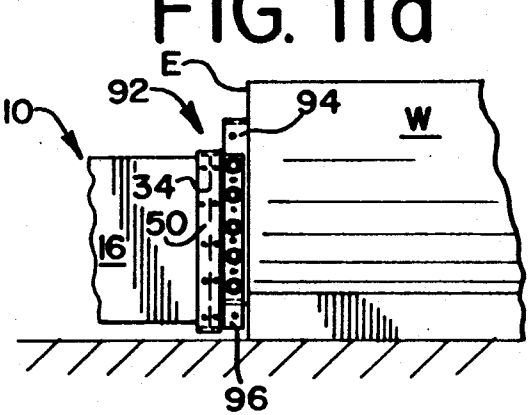

FIGS. 11*a* and 11*b* show two alternate positions of the backup cap 96 with respect to the mounting bracket 94. In both FIGS. 11*a* and 11*b* the entire crash barrier 10 is cantilevered out substantially parallel to the roadway, held only by the rear end cap 34 of the rear section 16. In the position shown in FIG. 11*a* the centerline of the crash barrier 10 is quite close to the roadway, and is well positioned to stop a vehicle having a low center of gravity. In the alternate position of FIG. 11*b* the centerline of the crash barrier 10 is positioned substantially higher as appropriate for a more conventional vehicle.

Figure 12A:
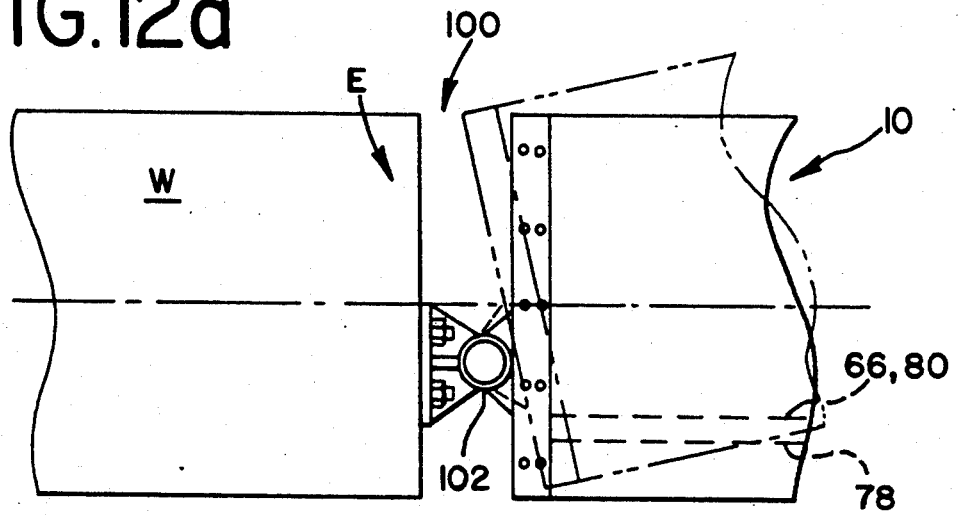
FIGS. 12*a*, 12*b*, and 12*c* are fragmentary top views of three alternative mounting arrangements for the crash barrier 10 of FIG. 2.
Figure 12B:
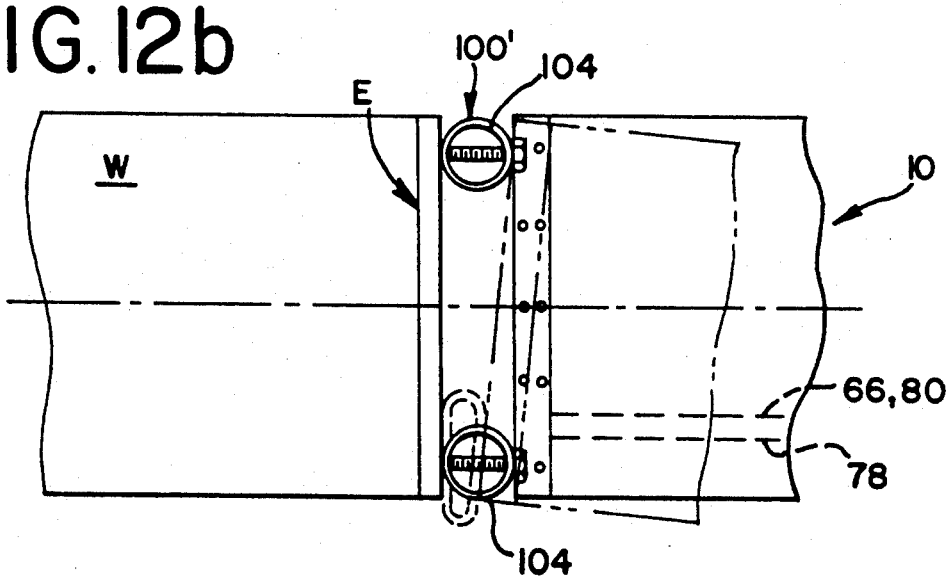
Figure 12C:
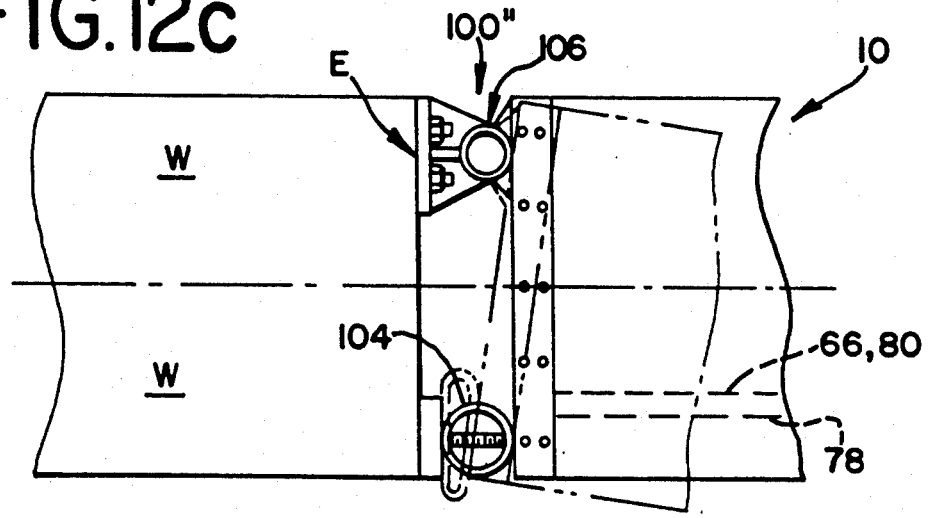

FIGS. 12*a*–12*c* show top views of three alternative mounting arrangements 100, 100', 100'' for securing the crash barrier 10 to a wall W. All three mounting arrangements 100, 100', 100'' define vertical pivot axes that facilitate rotation of the crash barrier 10 in a horizontal plane. The preferred bending direction of the crash barrier is also oriented in a horizontal plane, and the mounting arrangements 100, 100', 100'' increase the redirection capability of the crash barrier 10.

The mounting arrangement 100 includes a hinge 102 positioned to the same side of the longitudinal axes 46 of the barrier 10 as are the eccentric axes 66, 78, 80 of the eccentrically positioned columns 62, 72, 74.

The mounting arrangement 100' interposes two collapsible tubes 104 between the barrier 10 and the wall W. These tubes 104 are vertically oriented and are preferably sufficiently stiff that they do not begin to collapse until after the forward section of the barrier has collapsed to a substantial extent. Then the more heavily loaded tube 104 (often the tube 104 closer to the eccentric axes 66, 78, 80) begins to collapse, thereby allowing rotation of the rearward end of the barrier. In this way the mounting arrangement 100' initially supports the barrier rigidly, and it is the axial forces that are developed during an impact that trigger the onset of rotation of the mounting arrangement 100'.

The mounting arrangement 100'' is similar to the mounting arrangement 100' except that the tube 104 farther from the eccentric axes 66, 78, 80 is replaced with a hinge 106 to ensure that rotation is in a clockwise direction as shown in dotted lines in FIG. 12*c*.

In operation, the barrier 10 decelerates an axially impacting vehicle and redirects it to one side of the end E of the wall W. The forward section 12 is less stiff axially than the middle section 14, which is in turn less stiff axially than the rearward section 16. It has been found that for expanded metal sheets of the type described above the stiffness of the column is less when the minor axis 28 is positioned parallel to the longitudinal axis of the column, than when the major axis 26 is positioned parallel to the longitudinal axis of the column. The geometry described above has been found to provide a staged collapse, in which the forward section 12 collapses substantially before the middle or rear sections 14, 16 begin to collapse.

Furthermore, as the middle and rear sections 14, 16 collapse, the eccentric positioning of the inner column 62 and the inner and intermediate columns 72, 74, along with the asymmetrical positioning of the stiffeners 68, 70, 84, 86 define a preferred bending direction, which is along a horizontal transverse axis in this embodiment, directed to the side of the sections 14, 16 opposite the longer stiffeners 70, 86. In effect, the barrier defines a stronger side that is more resistant to collapse than a weaker side, and the barrier 10 tends to collapse toward the weaker side, thereby redirecting an axially-impacting vehicle away from the wall W. All of these advantages are obtained with a complete absence of any sort of supporting framework, because the crash barrier 10 is supported only at the backup cap 96 connected to the rear of the rear section 16.

Simply by way of example, and without in any way restricting the scope of this invention, the following materials and dimensions have been found suitable for one version of the apparatus 10. The expanded metal for the columns 18, 60, 62, 72, 74, 76 and the retainer 32 may be of the type sold by Ryerson as Ryex 9 gauge expanded steel sheet (flattened) having a minor axis $\frac{3}{4}$ inch long (measured from center to center of the adjacent metal nodes). The columns may have a length of 44 inches and diameters of 22, 15 and 11 inches. The columns 62, 74 may be laterally offset by $2\frac{1}{2}$ inches and the column 72 may be offset by $3\frac{1}{2}$ inches with respect to the outer columns 60, 76. The end caps 34, 36, the braces 44, the coupling straps 50 and the stiffeners 68, 70, 84, 86 may all be formed of 10 gauge steel (ASTM A569), and the skin panels 54 may be formed of 0.032 aluminum (5052-H32). The foam that fills the region within the outer columns 18, 60, 76 may be polyurethane foam such as PDL 205-2 (Polymer Development Laboratories Inc., Orange, Calif.), which may be foamed in place with a density of about two pounds per cubic foot.

The preferred embodiment described above has been tested in full scale crash tests, and has been found to provide a number of important advantages. First, the foam and the perforated metal cylinders cooperate such that each enhances operation of the other. The foam internally braces the metal cylinders to prevent undesired buckling and folding, and to cause a relatively high volume of the metal to be strained to a relatively high degree. This provides high energy absorption capacity. Similarly, the metal column contains the foam, eliminates widespread dispersal of the foam in an impact, and reduces or eliminates undesired springback. The energy absorption capacity of the complete element is greater than the sum of the energy absorption capacities of the individual components.

The internal bracing provided by the foam provides a surprisingly high column stability. The preferred embodiment has been found to be column stable with a length to diameter ratio in excess of 3:1. The preferred embodiment described above has a length to diameter ratio of approximately 6:1 and functions as a cantilevered beam without any sort of external supporting framework. Of course, length to diameter ratios below 3:1 and greater than 6:1 are possible.

Furthermore, the preferred embodiment described above has been found to collapse in a staged manner, as desired. Because the front column is more easily collapsed than the rear columns (due to orientation of the perforations and the increased number of columns in the rear energy-absorbing elements as compared with the forward energy-absorbing element) the barrier sequentially collapses section by section.

Furthermore, the asymmetrical stiffeners and the eccentric positioning of the columns described above have been found to redirect an axially impacting vehicle. Thus, a vehicle with excessive kinetic energy that cannot be completely stopped by the barrier can be redirected to one side of the barrier or above the barrier to reduce the maximum deceleration experienced by occupants of the vehicle.

All of these advantages are obtained in a barrier which is relatively inexpensive, lightweight, compact, and insensitive to environmental conditions such as temperature. As pointed out above, this embodiment is well suited for use in impacts with low center of gravity vehicles and narrow hazard applications, and the height of the barrier can readily be adjusted since no external supporting frame is required.

Of course, a wide range of changes and modifications can be made to the preferred embodiment described above. The columns may be formed of alternative materials such as aluminum or even non-metallic rigid sheets. The perforations may be formed by welding components together, as well as by creating openings in a preexisting sheet. The columns may have axial edges which overlap substantially, thereby eliminating the need for axial welds. The size, shape and orientation of the perforations, the thickness of the column forming sheet, the size and shape of the column, the material from which the column is made, the number of columns, and the diameters and heights of the columns can all be adjusted as desired to provide the desired energy-absorbing characteristics. Additionally, other foams such as polystyrene can be used, as well as foams with fillers or voids. It is anticipated that lower density foams may well provide adequate operating characteristics while further reducing the weight and cost of the barrier. The foam may be formed of pre-sized blocks shaped to fit the columns, or may alternately be formed of small preformed foam elements adhesively secured or bonded together with the columns.

It is therefore intended that the foregoing detailed description be regarded as illustrative rather than limiting, and that it be understood that it is the following claims, including all equivalents, which are intended to define the scope of this invention.

I claim:

1. A vehicle crash barrier adapted to decelerate an impacting vehicle, said crash barrier comprising:

at least one energy-absorbing element comprising at least one column and a foam disposed within the column, wherein the column comprises a sheet of material which defines an array of perforations extending along and around the column, wherein the column defines a longitudinal axis extending along a length direction of the column; and a mounting system coupled to the column and configured to mount the column alongside a roadway with the longitudinal axis extending substantially parallel to the roadway;

said column having sufficient rigidity such that, when an impacting vehicle having an initial kinetic energy impacts the energy-absorbing element and collapses the column along the longitudinal axis, the foam braces the column against buckling, and deformation of the column absorbs a greater fraction of the initial kinetic energy than does deformation of the foam.

2. The invention of claim 1 wherein the sheet of material comprises an expanded metal sheet.

3. The invention of claim 1 wherein the column comprises a pair of end caps, each secured to a respective end of the sheet of material.

4. The invention of claim 3 further comprising a retainer disposed within the column adjacent one of the end caps, said retainer secured to the sheet of material thereby retaining the foam in the column in the event the adjacent end cap is separated from the column as the column is collapsed during an impact.

5. The invention of claim 1 wherein the energy-absorbing element further comprises a second column disposed within and oriented generally parallel to the first mentioned column, said second column comprising a second sheet of material which defines a second array of perforations extending along and around the second column.

6. The invention of claim 5 wherein the first mentioned and second columns are eccentrically positioned one within the other thereby defining a preferred bending direction for the energy-absorbing element.

7. The invention of claim 1 wherein the column comprises at least one stiffener secured to the sheet of material of the column thereby selectively stiffening a portion of the column against bending.

8. The invention of claim 1 wherein the mounting system comprises means for rotatably mounting the energy-absorbing element to an obstruction positioned alongside a roadway to facilitate movement of the energy-absorbing element in a preferred bending direction.

9. The invention of claim 8 wherein the mounting means comprises:

means for rigidifying the mounting means during an initial portion of axial collapse of the energy-absorbing element.

10. The invention of claim 1 wherein the vehicle crash barrier comprises a plurality of said energy-absorbing elements rigidly secured together and forming a beam, and wherein the mounting system comprises a mounting bracket secured to one of the energy-absorbing elements and cantilevering the beam substantially horizontally above a roadway.

11. The invention of claim 10 wherein the beam defines a length and a diameter, and wherein the ratio of length to diameter is greater than 3:1.

12. The invention of claim 11 wherein the ratio is at least 6:1.

13. A vehicle crash barrier adapted to decelerate an impacting vehicle, said crash barrier comprising:

at least one energy-absorbing element comprising a column and a foam disposed within the column, wherein the column comprises a sheet of material which defines an array of perforations extending along and around the column;

said energy-absorbing element and said column each defining a respective central longitudinal axis;

said element and column longitudinal axes being offset with respect to one another such that the column is eccentrically positioned in the energy-absorbing element toward a first side of the energy-absorbing element along a transverse axis;

said column having a sufficient rigidity to define a preferred bending direction for the energy-absorbing element;

said preferred bending direction generally aligned with the transverse axis such that a redirecting force aligned with the transverse axis is applied to an axially impacting vehicle during axial collapse of the energy-absorbing element.

14. The invention of claim 13 wherein the energy-absorbing element comprises a plurality of columns comprising a larger column and a smaller column, the smaller column disposed within the larger column, each column comprising a respective sheet of material which defines a respective array of perforations extending along and around the respective column, each column defining a respective column longitudinal axis, said column longitudinal axes being parallel and laterally spaced from one another along the transverse axis.

15. The invention of claim 14 wherein the plurality of columns comprises three columns.

16. The invention of claim 14 wherein at least one of said columns comprises a plurality of stiffeners comprising at least one first stiffener which braces the column against lateral bending to a greater extent than a second stiffener, said first stiffener offset with respect to the central column longitudinal axis toward the first side thereby increasing the redirecting force.

17. The invention of claim 14 wherein at least one of the columns comprises at least one stiffener, said at least one stiffener asymmetrically arranged with respect to the respective column longitudinal axis to increase the stiffness of the column toward the first side thereby increasing the redirecting force.

18. The invention of claim 13 wherein the sheet of material comprises an expanded metal sheet formed into a tube.

19. The invention of claim 13 wherein the column of the energy-absorbing element is configured with sufficient rigidity such that, when an impacting vehicle having an initial kinetic energy impacts the energy-absorbing element and collapses the energy-absorbing element along the element longitudinal axis, the foam braces the column against buckling, and deformation of the column absorbs a greater fraction of the initial kinetic energy than does deformation of the foam..

20. The invention of claim 13 further comprising means for rotatably mounting the energy-absorbing element to an obstruction positioned alongside a roadway thereby facilitating movement of the energy-absorbing element in the preferred bending direction.

21. The invention of claim 20 wherein the mounting means comprises:

means for rigidifying the mounting means during an initial portion of axial collapse of the energy-absorbing element.

22. The invention of claim 13 wherein the vehicle crash barrier comprises a plurality of said energy-absorbing elements rigidly secured together thereby forming a beam, and wherein the invention further comprises a mounting bracket secured to one of the energy-absorbing elements and cantilevering the beam substantially horizontally above a roadway.

23. The invention of claim 22 wherein the beam defines a length and a diameter, and wherein the ratio of length to diameter is greater than 3:1.

24. The invention of claim 23 wherein the ratio is at least 6:1.

25. A vehicle crash barrier adapted to decelerate an impacting vehicle, said crash barrier comprising:

a plurality of energy-absorbing elements arranged along a longitudinal axis from a forward end to a rearward end;

a mounting system coupled to at least one of the energy absorbing elements for mounting the energy absorbing elements alongside a roadway with the longitudinal axis extending substantially parallel to the roadway;

at least first and second ones of the energy-absorbing elements each comprising at least one column defining a length direction substantially aligned with the longitudinal axis and a foam disposed within the column, each of said columns comprising a sheet of material which defines an array of perforations extending along and around the column;

said first energy-absorbing element being closer to the forward end than is the second energy-absorbing element;

said columns configured to provide a greater axial stiffness in the second than in the first energy-absorbing element such that the first energy-absorbing element is predisposed to begin to collapse axially before the second energy-absorbing element when the longitudinal axis is oriented generally parallel to an adjacent roadway and the crash barrier is struck at the forward end by an impacting vehicle.

26. The invention of claim 25 wherein the first energy-absorbing element comprises a smaller number of columns than the second energy-absorbing element.

27. The invention of claim 25 wherein at least selected ones of the columns each comprise a plurality of stiffeners, and wherein the stiffeners are arranged to provide increased axial stiffness to the second energy-absorbing element as compared to the first energy-absorbing element.

28. The invention of claim 27 wherein the stiffeners of at least one of the energy-absorbing elements are disposed asymmetrically about the longitudinal axis of the respective energy-absorbing element to selectively stiffen a first side of the energy-absorbing element to define a preferred bending direction for the energy-absorbing element.

29. The invention of claim 25 wherein the sheets of material of the columns each comprise a respective tubular sheet of expanded metal.

30. The invention of claim 29 wherein the perforations of the expanded metal sheets each define a major axis and a minor axis and

31. The invention of claim 25 wherein the column of at least the second energy-absorbing element is configured with sufficient rigidity such that, when an impacting vehicle having an initial kinetic energy impacts the crash barrier and collapses the second energy-absorbing element along the longitudinal axis, the foam braces the column against buckling, and deformation of the column absorbs a greater fraction of the initial kinetic energy than does deformation of the foam.

32. The invention of claim 25 wherein at least the second energy-absorbing element comprises stiffeners secured to a respective one of the columns and selectively axially stiffening the second energy-absorbing element with respect to the first energy-absorbing element.

33. The invention of claim 25 further comprising:

means for rigidly securing adjacent ones of the energy-absorbing elements together to form a beam; and a mounting bracket secured to one of the energy-absorbing elements and cantilevering the beam substantially horizontally above a roadway.

34. The invention of claim 33 wherein the beam defines a length and a diameter, and wherein the ratio of length to diameter is greater than 3:1.

35. The invention of claim 34 wherein the ratio is at least 6:1.

36. The invention of claim 25 further comprising means for rotatably mounting a rearward one of the energy-absorbing elements to an obstruction positioned alongside a roadway.

37. A vehicle crash barrier adapted to decelerate an impacting vehicle, said crash barrier comprising:

at least one energy-absorbing element comprising at least one column and a foam disposed within the column, wherein the column comprises a sheet of material which defines an array of perforations extending along and around the column, wherein the column defines a longitudinal axis extending along a length direction of the column;

said column having sufficient rigidity such that, when an impacting vehicle having an initial kinetic energy impacts the energy-absorbing element and collapses the column along the longitudinal axis, the foam braces the column against buckling, and deformation of the column absorbs a greater fraction of the initial kinetic energy than does deformation of the foam;

wherein the column comprises a pair of end caps, each secured to a respective end of the sheet of material;

a retainer disposed within the column adjacent one of the end caps, said retainer secured to the sheet of material thereby retaining the foam in the column in the event the adjacent end cap is separated from the column as the column is collapsed during an impact.

38. A vehicle crash barrier adapted to decelerate an impacting vehicle, said crash barrier comprising:

at least one energy-absorbing element comprising at least one column and a foam disposed within the column, wherein the column comprises a sheet of material which defines an array of perforations extending along and around the column, wherein the column defines a longitudinal axis extending along a length direction of the column;

said column having sufficient rigidity such that, when an impacting vehicle having an initial kinetic energy impacts the energy-absorbing element and collapses the column along the longitudinal axis, the foam braces the column against buckling, and deformation of the column absorbs a greater fraction of the initial kinetic energy than does deformation of the foam;

wherein the energy-absorbing element further comprises a second column disposed within and oriented generally parallel to the first mentioned column, said second column comprising a second sheet of material which defines a second array of perforations extending along and around the second column.

39. The invention of claim 38 wherein the first mentioned and second columns are eccentrically positioned one within the other thereby defining a preferred bending direction for the energy-absorbing element.

40. A vehicle crash barrier adapted to decelerate an impacting vehicle, said crash barrier comprising:

at least one energy-absorbing element comprising at least one column and a foam disposed within the column, wherein the column comprises a sheet of material which defines an array of perforations extending along and around the column, wherein the column defines a longitudinal axis extending along a length direction of the column;

said column having sufficient rigidity such that, when an impacting vehicle having an initial kinetic energy impacts the energy-absorbing element and collapses the column along the longitudinal axis, the foam braces the column against buckling, and deformation of the column absorbs a greater fraction of the initial kinetic energy than does deformation of the foam; and means for rotatably mounting the energy-absorbing element to an obstruction positioned alongside a roadway and facilitating movement of the energy-absorbing element in a preferred bending direction.

41. The invention of claim 40 wherein the mounting means comprises:

means for rigidifying the mounting means during an initial portion of axial collapse of the energy-absorbing element.

42. A vehicle crash barrier adapted to decelerate an impacting vehicle, said crash barrier comprising:

a plurality of energy-absorbing elements arranged along a longitudinal axis from a forward end to a rearward end;

at least first and second ones of the energy-absorbing elements each comprising at least one column defining a length direction substantially aligned with the longitudinal axis and a foam disposed within the column, each of said columns comprising a sheet of material which defines an array of perforations extending along and around the column;

said first energy-absorbing element being closer to the forward end than is the second energy-absorbing element;

said columns configured to provide a greater axial stiffness in the second than in the first energy-absorbing element such that the first energy-absorbing element is predisposed to begin to collapse axially before the second energy-absorbing element when the crash barrier is struck at the forward end by an impacting vehicle;

wherein the first energy-absorbing element comprises a smaller number of columns than the second energy-absorbing element.

43. A vehicle crash barrier adapted to decelerate an impacting vehicle, said crash barrier comprising:

a plurality of energy-absorbing elements arranged along a longitudinal axis from a forward end to a rearward end;

at least first and second ones of the energy-absorbing elements each comprising at least one column defining a length direction substantially aligned with the longitudinal axis and a foam disposed within the column, each of said columns comprising a sheet of material which defines an array of perforations extending along and around the column;

said first energy-absorbing element being closer to the forward end than is the second energy-absorbing element;

said columns configured providing a greater axial stiffness in the second than in the first energy-absorbing element such that the first energy-absorbing element is predisposed to begin to collapse axially before the second energy-absorbing element when the crash barrier is struck at the forward end by an impacting vehicle;

wherein at least selected ones of the columns each comprise a plurality of stiffeners, and wherein the stiffeners are arranged to provide increased axial stiffness to the second energy-absorbing element as compared to the first energy-absorbing element.

44. The invention of claim 43 wherein the stiffeners of at least one of the energy-absorbing elements are disposed asymmetrically about the longitudinal axis of the respective energy-absorbing element thereby selectively stiffening a first side of the energy-absorbing element to define a preferred bending direction for the energy-absorbing element.

45. A vehicle crash barrier adapted to decelerate an impacting vehicle, said crash barrier comprising:

a plurality of energy-absorbing elements arranged along a longitudinal axis from a forward end to a rearward end;

at least first and second ones of the energy-absorbing elements each comprising at least one column defining a length direction substantially aligned with the longitudinal axis and a foam disposed within the column, each of said columns comprising a sheet of material which defines an array of perforations extending along and around the column;

said first energy-absorbing element being closer to the forward end than is the second energy-absorbing element;

said columns configured to provide a greater axial stiffness in the second than in the first energy-absorbing element such that the first energy-absorbing element is predisposed to begin to collapse axially before the second energy-absorbing element when the crash barrier is struck at the forward end by an impacting vehicle;

wherein the sheets of material of the columns each comprise a respective tubular sheet of expanded metal;

wherein the perforations of the expanded metal sheets each define a major axis and a minor axis;

wherein at least one of the expanded metal sheets of the first energy-absorbing element is oriented with the minor axes of the perforations parallel to the longitudinal axis; and wherein at least one of the expanded metal sheets of the second energy-absorbing element is oriented with the major axes of the perforations parallel to the longitudinal axis.

46. A vehicle crash barrier adapted to decelerate an impacting vehicle, said crash barrier comprising:

a plurality of energy-absorbing elements arranged along a longitudinal axis from a forward end to a rearward end;

at least first and second ones of the energy-absorbing elements each comprising at least one column defining a length direction substantially aligned with the longitudinal axis and a foam disposed within the column, each of said columns comprising a sheet of material which defines an array of perforations extending along and around the column;

said first energy-absorbing element being closer to the forward end than is the second energy-absorbing element;

said columns configured to provide a greater axial stiffness in the second than in the first energy-absorbing element such that the first energy-absorbing element is predisposed to begin to collapse axially before the second energy-absorbing element when the crash barrier is struck at the forward end by an impacting vehicle;

wherein at least the second energy-absorbing element comprises stiffeners secured to a respective one of the columns to selectively axially stiffen the second energy-absorbing element with respect to the first energy-absorbing element.

47. A vehicle crash barrier adapted to decelerate an impacting vehicle, said crash barrier comprising:

a plurality of energy-absorbing elements arranged along a longitudinal axis from a forward end to a rearward end;

at least first and second ones of the energy-absorbing elements each comprising at least one column defining a length direction substantially aligned with the longitudinal axis and a foam disposed within the column, each of said columns comprising a sheet of material which defines an array of perforations extending along and around the column;

said first energy-absorbing element being closer to the forward end than is the second energy-absorbing element;

said columns configured to provide a greater axial stiffness in the second than in the first energy-absorbing element such that the first energy-absorbing element is predisposed to begin to collapse axially before the second energy-absorbing element when the crash barrier is struck at the forward end by an impacting vehicle; and means for rotatably mounting a rearward one of the energy-absorbing elements to an obstruction positioned alongside a roadway.

* * * * *

UNITED STATES PATENT AND TRADEMARK OFFICE

CERTIFICATE OF CORRECTION

PATENT NO. : 5,192,157
DATED : March 9, 1993
INVENTOR(S) : John F. Laturner

It is certified that error appears in the above-indentified patent and that said Letters Patent is hereby corrected as shown below:

Column 4, line 62, please delete "Within" and substitute therefor --within--.

Column 9, line 23, please delete "with" and substitute therefor --within--.

Column 12, line 17, please delete "to" and substitute therefor --thereby--.

Column 12, line 18, please delete "stiffen" and substitute therefor --stiffening--.

Column 12, line 18, please delete "to" and substitute therefor --and--.

Column 12, line 19, please delete "define" and substitute therefor --defining--.

UNITED STATES PATENT AND TRADEMARK OFFICE

CERTIFICATE OF CORRECTION

PATENT NO. : 5,192,157

DATED : March 9, 1993

INVENTOR(S) : John F. Laturner

It is certified that error appears in the above-indentified patent and that said Letters Patent is hereby corrected as shown below:

Column 12, line 26, after "and" please insert --wherein at least one of the expanded metal sheets of the first energy-absorbing element is oriented with the minor axes of the perforations parallel to the longitudinal axis, and wherein at least one of the expanded metal sheets of the second energy-absorbing element is oriented with the major axes of the perforations parallel to the longitudinal axis.--.

Claim 43, line 16, please delete "configured".

Signed and Sealed this

Second Day of August, 1994

Bruce Lehman

*Attest:*

BRUCE LEHMAN

*Attesting Officer*

*Commissioner of Patents and Trademarks*